US008690145B2

(12) United States Patent
Togawa

(10) Patent No.: US 8,690,145 B2
(45) Date of Patent: Apr. 8, 2014

(54) IMAGE FORMING SYSTEM AND IMAGE FORMING DEVICE

(75) Inventor: Takanori Togawa, Tachikawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 224 days.

(21) Appl. No.: 13/398,164

(22) Filed: Feb. 16, 2012

(65) Prior Publication Data

US 2012/0219386 A1 Aug. 30, 2012

(30) Foreign Application Priority Data

Feb. 24, 2011 (JP) ..... 2011-037794

(51) Int. Cl.
*B42B 5/08* (2006.01)
*B65H 5/00* (2006.01)

(52) U.S. Cl.
USPC ..... 270/58.11; 270/58.07; 270/58.08; 270/58.23; 412/38; 412/42

(58) Field of Classification Search
USPC ..... 270/58.07, 58.08, 58.09, 58.11, 58.23; 271/9.01, 264; 412/4, 6, 7, 18, 19, 20, 412/33, 38, 39, 40, 42
See application file for complete search history.

(56) References Cited

U.S. PATENT DOCUMENTS

| | | | | |
|---|---|---|---|---|
| 4,540,458 | A * | 9/1985 | Baughman et al. | 156/312 |
| 5,601,389 | A * | 2/1997 | Minami | 412/14 |
| 7,080,830 | B2 * | 7/2006 | Suzuki et al. | 270/58.08 |
| 8,556,249 | B2 * | 10/2013 | Ando et al. | 270/58.09 |
| 2009/0269166 | A1 * | 10/2009 | Richards | 412/7 |

FOREIGN PATENT DOCUMENTS

| | | | |
|---|---|---|---|
| JP | 08-101542 | A | 4/1996 |
| JP | 10-307507 | A | 11/1998 |

* cited by examiner

*Primary Examiner* — Leslie A Nicholson, III
(74) *Attorney, Agent, or Firm* — Holtz, Holtz, Goodman & Chick

(57) ABSTRACT

Disclosed is an image forming system including an image forming device which includes a paper feeding tray, a print section which performs printing to papers fed from the paper feeding tray and a control section which controls so as to feed the printed papers to a post-processing device as a booklet main body to be book-bound, and the post-processing device which carries out ring-binding processing to the fed papers and book-binds a booklet, and the control section controls so as to feed a front cover paper, a back cover paper, papers for binding of the booklet to a ring-binding process section of the post-processing device along with the booklet main body, and a paper feeding order is in an order of the back cover paper, the papers for binding, the front cover paper and the booklet main body.

8 Claims, 15 Drawing Sheets

IMAGE FORMING SYSTEM AND IMAGE FORMING DEVICE

BACKGROUND OF THE INVENTION

1. Field of the Invention

The present invention relates to an image forming system and an image forming device.

2. Description of Related Art

Image forming devices which perform copying and printing are popularly used and they are becoming more and more user-friendly. For example, image forming devices which can perform printing by using special papers such as OHP sheets, not only regular papers, are becoming popularly used (For example, see JP H10-307507 and JP H08-101542).

Moreover, a post-processing device can be connected to the image forming device, and a booklet can be book-bound by performing post-processing such as hole-punching processing, stapling processing, folding processing to the papers to which printing is performed by the image forming device. In recent years, there are developed post-processing devices which can produce booklets which are bound by ring-binding members.

In the post-processing device, a book-binding is possible by attaching front cover and back cover to a booklet main body. However, there are requests to carry out book-binding by further binding the front cover and the back cover with special papers such as OHP sheets. This is because, OHP sheets are reinforced to some extent comparing to regular papers and they also look appealing.

In the conventional image forming device, feeding of OHP sheets is controlled in the image forming device for printing. However, a control for feeding OHP sheets to the post-processing device which is connected following the image forming device is not carried out. For example, in the image forming device described in JP H10-307507, feeding of OHP sheets and regular papers to the print section is controlled to attach the regular papers as inserting papers of the OHP sheets to which printing is to be performed, however, a control for feeding the OHP sheets and regular papers to the post-processing device is not carried out. Similarly, in the image forming device described in JP H08-101542, a control is carried out so as to feed a regular paper, not OHP sheet, at the time of test copy, however, paper feeding control to the post-processing device is not carried out. Therefore, conventionally, the papers used for binding front cover and back cover, such as OHP sheets, could not be fed to the post-processing device.

Moreover, there are variety of ring-binding members, and the paper feeding order of the papers to be fed to the post-processing device needed to be controlled so that the papers in the final booklet will be in a correct order in a sequence of binding of front cover, front cover, booklet main body, back cover and binding of back cover according to the ring-binding member to be used.

SUMMARY OF THE INVENTION

An object of the present invention is to realize binding of front cover or back cover of a booklet to be book-bound.

In order to achieve the above object, according to one aspect of the present invention, an image forming system includes an image forming device including a paper feeding tray, a print section which performs printing to papers fed from the paper feeding tray and a control section which controls so as to feed the printed papers to a post-processing device as a booklet main body to be book-bound, and the post-processing device which carries out ring-binding processing to the fed papers and book-binds a booklet, and the control section controls so as to feed a front cover paper, a back cover paper, papers for binding of the booklet to a ring-binding process section of the post-processing device along with the booklet main body, and a paper feeding order is in an order of the back cover paper, the papers for binding, the front cover paper and the booklet main body.

Moreover, according to another aspect of the present invention, An image forming device including a paper feeding tray, a print section which performs printing to papers fed from the paper feeding tray and a control section which controls so as to carry out ring-binding processing to the fed papers and to feed the printed papers to a post-processing device which book-binds a booklet as a booklet main body to be book-bound, and the control section controls so as to feed a front cover paper, a back cover paper, papers for binding of the booklet to a ring-binding process section of the post-processing device along with the booklet main body, and a paper feeding order is in an order of the back cover paper, the papers for binding, the front cover paper and the booklet main body.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, an embodiment of the present invention will be described with reference to the drawings.

Figure 1:
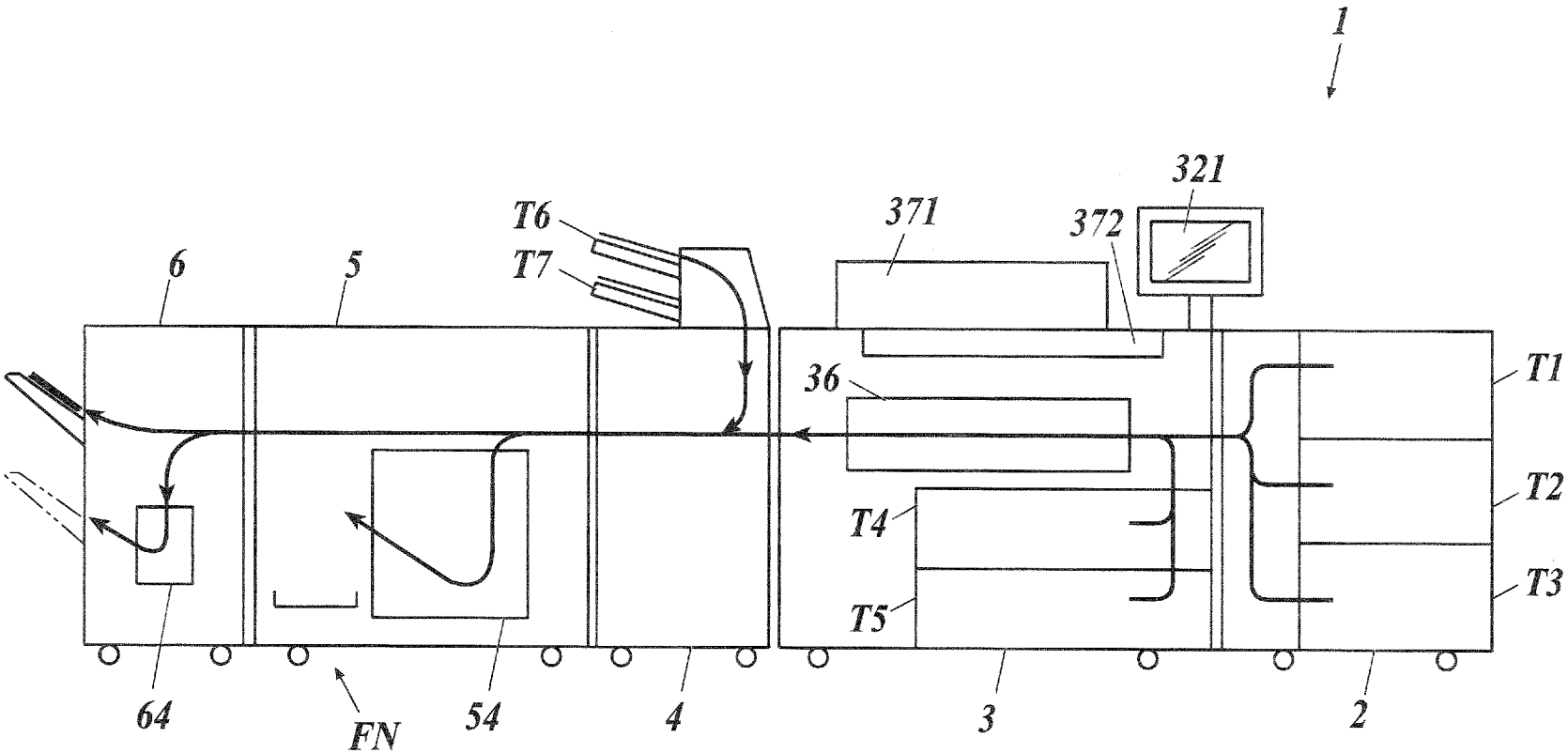
FIG. 1 is a diagram showing an image forming system according to an embodiment.

FIG. 1 shows an image forming system 1 according to the embodiment.

As shown in FIG. 1, the image forming system 1 includes an image forming device 3, a paper insertion device 4 and a post-processing device FN. In FIG. 1, the arrows indicate conveyance directions of a paper or a bundle of papers.

The image forming device 3 includes a paper feeding unit 2, an automatic document feeder 371, a scanner 372, paper feeding trays T4 and T5, a touch panel 321, a print section 36 and so forth, and the image forming device 3 performs printing on papers. The paper feeding unit 2 includes a plurality of paper feeding trays T1 to T3, and the paper feeding unit 2 feeds papers to the print section 36. The papers to which printing is performed by the print section 36 are conveyed to the paper insertion device 4 sequentially, and then, are fed to the post-processing device FN.

The paper insertion device 4 includes paper feeding trays T6 and T7 provided in a stacked manner one being at the top of the other. The paper feeding trays T6 and T7 can feed a front cover, a back cover and papers for binding the front cover and back cover which are used for book-binding. The paper insertion device 4 feeds the papers set in the upper paper feeding tray T6 and the lower paper feeding tray T7 to the post-processing device FN according to an instruction input from the image forming device 3. Further, the paper insertion device 4 feeds the papers to which printing is performed by the image forming device 3 to the post-processing device FN.

The post-processing device FN includes a ring-binding unit 5 and a stapling unit 6, and the post-processing device FN performs post-processing to the papers which are fed.

Figure 2:
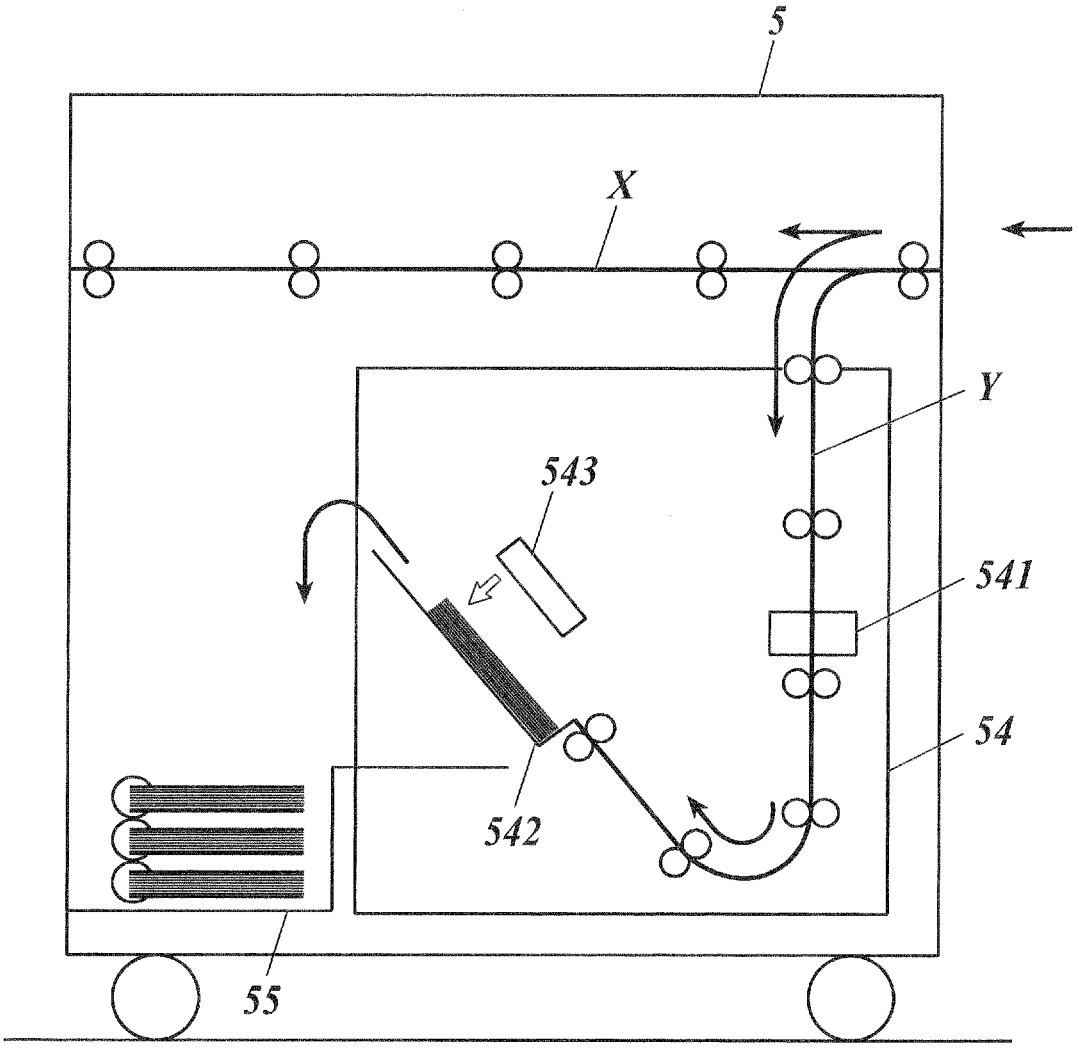
FIG. 2 is a diagram showing a ring-binding unit of a post-processing device in FIG. 1.

FIG. 2 shows a configuration of the ring-binding unit 5.

The ring-binding unit 5 has two conveyance paths X and Y and includes a ring-binding process section 54 on the conveyance path Y. When the ring-binding processing is not to be performed, the ring-binding unit 5 feeds the papers fed from the paper insertion device 4 to the stapling unit 6 via the conveyance path X. On the other hand, when the ring-binding processing is to be performed, the ring-binding unit 5 conveys the papers fed from the paper insertion device 4 to the conveyance path Y.

The ring-binding process section 54 includes a hole-punching section 541, a stacking section 542 and a binding section 543.

When a paper is conveyed to the conveyance path Y, the hole-punching section 541 performs hole-punching processing to the paper to open a plurality of holes for ring-binding. The paper to which hole-punching processing is performed is conveyed to and stacked in the stacking section 542. The binding section 543 fits the ring-binding member to bind the bundle of papers stacked in the stacking section 542. The booklet finalized by being bound is to be housed in the paper output tray 55.

Figure 3:
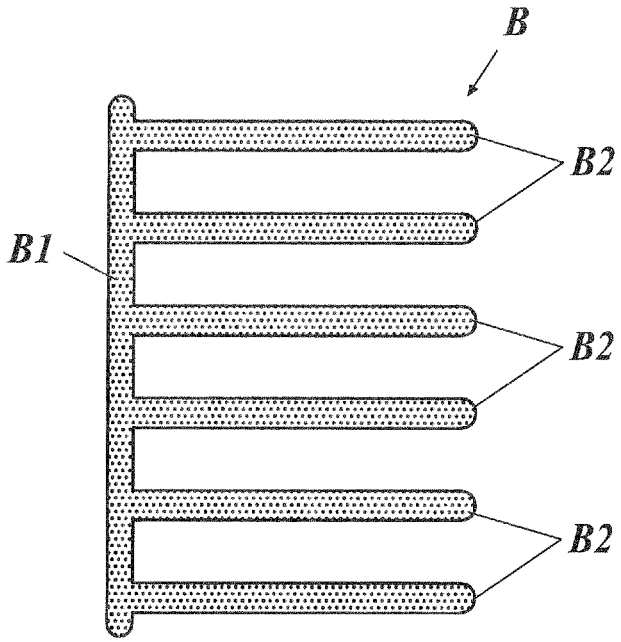
FIG. 3 is a diagram showing a ring-binding member.

FIG. 3 shows a ring-binding member B used for ring-binding processing.

The ring-binding member B is formed in a plate shape, and a plurality of ring forming portions B2 are provided at the supporting portion B1 like a comb as shown in FIG. 3. As a material of the ring-binding member B, resins such as polyester, cellulose esters and so forth can be used, for example.

Figure 4:
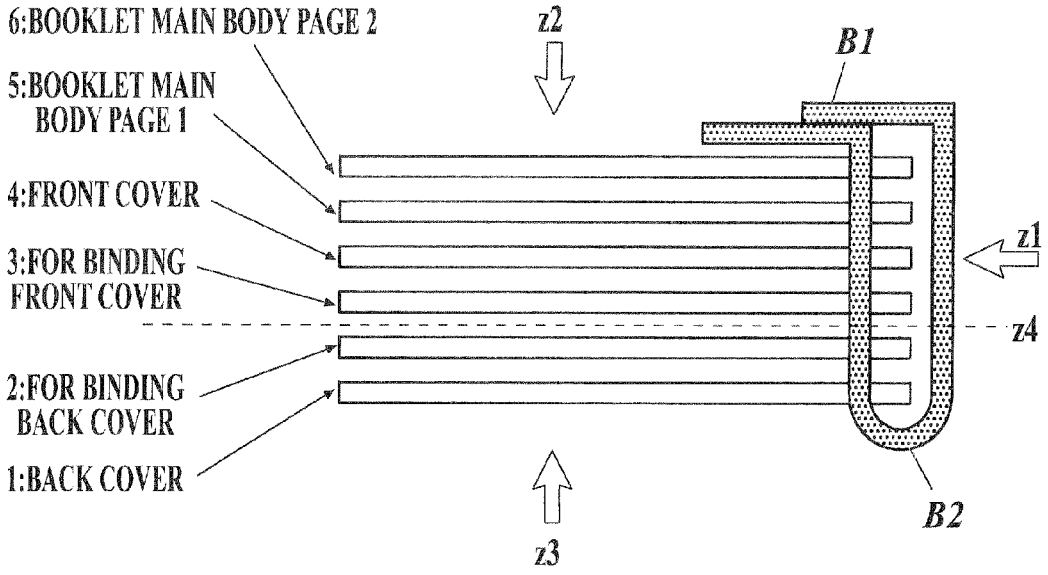
FIG. 4 is a cross-sectional view of a booklet bound by using the ring-binding member of FIG. 3.

As shown in FIG. 4, tips of the ring forming portions B2 of the binding section 543 are inserted respectively in the holes formed in the papers and the ring forming portions B2 are cylindrically bent, and thereafter, the portion of the ring forming portions B2 which overlap with the supporting portion B1 are adhered. In such way, the rings binding the bundle of papers are formed.

Figure 5:
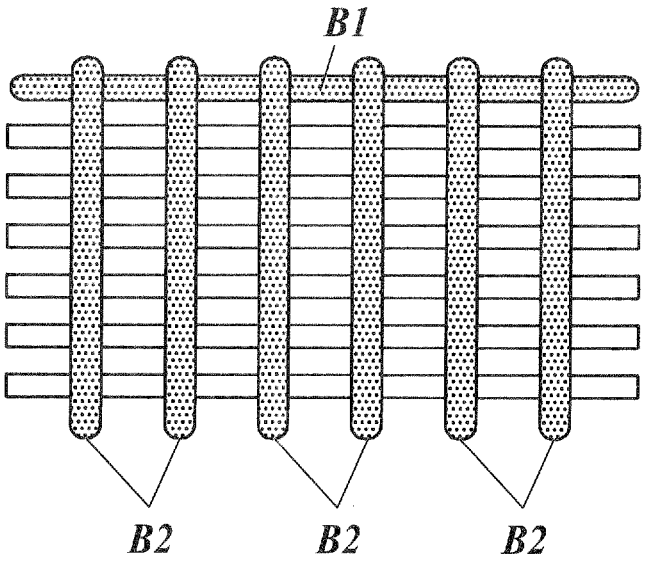
FIG. 5 is a side view when the booklet shown in FIG. 4 is seen from the rind part (spine)
Figure 6:
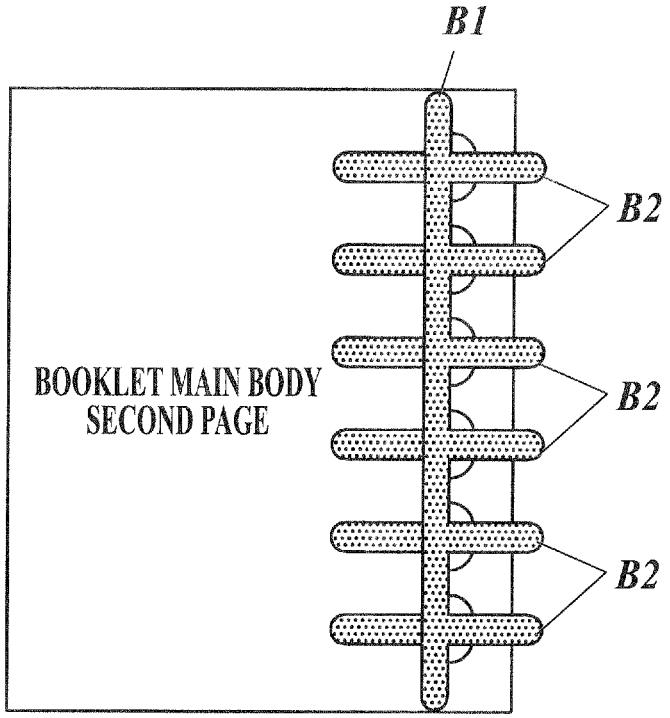
FIG. 6 is an upper surface of the booklet shown in FIG. 4.
Figure 7:
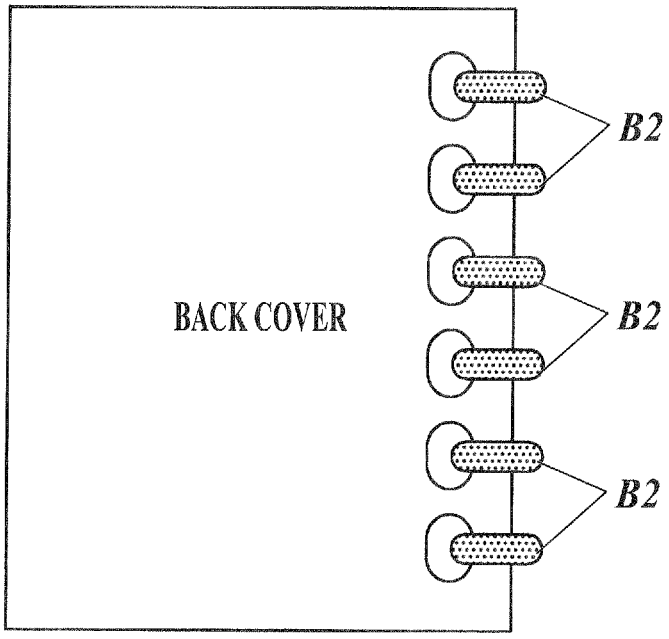
FIG. 7 is a base surface of the booklet shown in FIG. 4.

FIG. 5 is a diagram when the booklet shown in FIG. 4 is seen from the observing point z1, FIG. 6 is a diagram when the booklet is seen from the observing point z2 and FIG. 7 is a diagram when the booklet is seen from the observing point z3.

In the booklet to which ring-binding processing is performed, the adhesion part of the supporting portion B1 and the ring forming portions B2 extends from the rings formed by the ring forming portions B2 as shown in FIG. 4. When using the booklet, a user is to flip the papers at the flipping position z4 shown in FIG. 4 and puts the adhesion part inside the booklet. In such way, appearance of the booklet can be good and the extended adhesion part can be prevented from interfering when using the booklet.

Assuming the above way of using, the papers to which the ring-binding processing is to be performed need to be fed to the ring-binding process section 54 to be stacked in the order of (1) back cover, (2) paper for binding back cover, (3) paper for binding front cover, (4) front cover and (5) booklet main body when using the ring-binding member B.

Any type of papers can be used for front cover, back cover and papers for binding the front cover and the back cover upon user's choice. For example, reinforced papers such as cardboard papers or attractive papers such as color papers and coated papers can be used as papers for front cover and back cover. As for papers for binding the front cover or the back cover, papers which enforce the front cover and the back cover and which do not degrade the attractiveness of the front cover and the back cover, such as OHP sheets, and papers such as thin papers having decorative effect can be used.

The stapling unit 6 includes a stapling process section 64. Similarly to the ring-binding unit 5, the conveyance path is switched between two conveyance paths in the stapling unit 6. That is, the papers subject to the stapling processing are fed to the conveyance path in which the stapling process section 64 is provided and the other papers which are not subject to the stapling processing are conveyed to the other conveyance path to be discharged into the paper output tray. In the stapling process section 64, the fed papers are loaded and bound by staples. The bound papers are discharged into the paper output tray.

Figure 8:
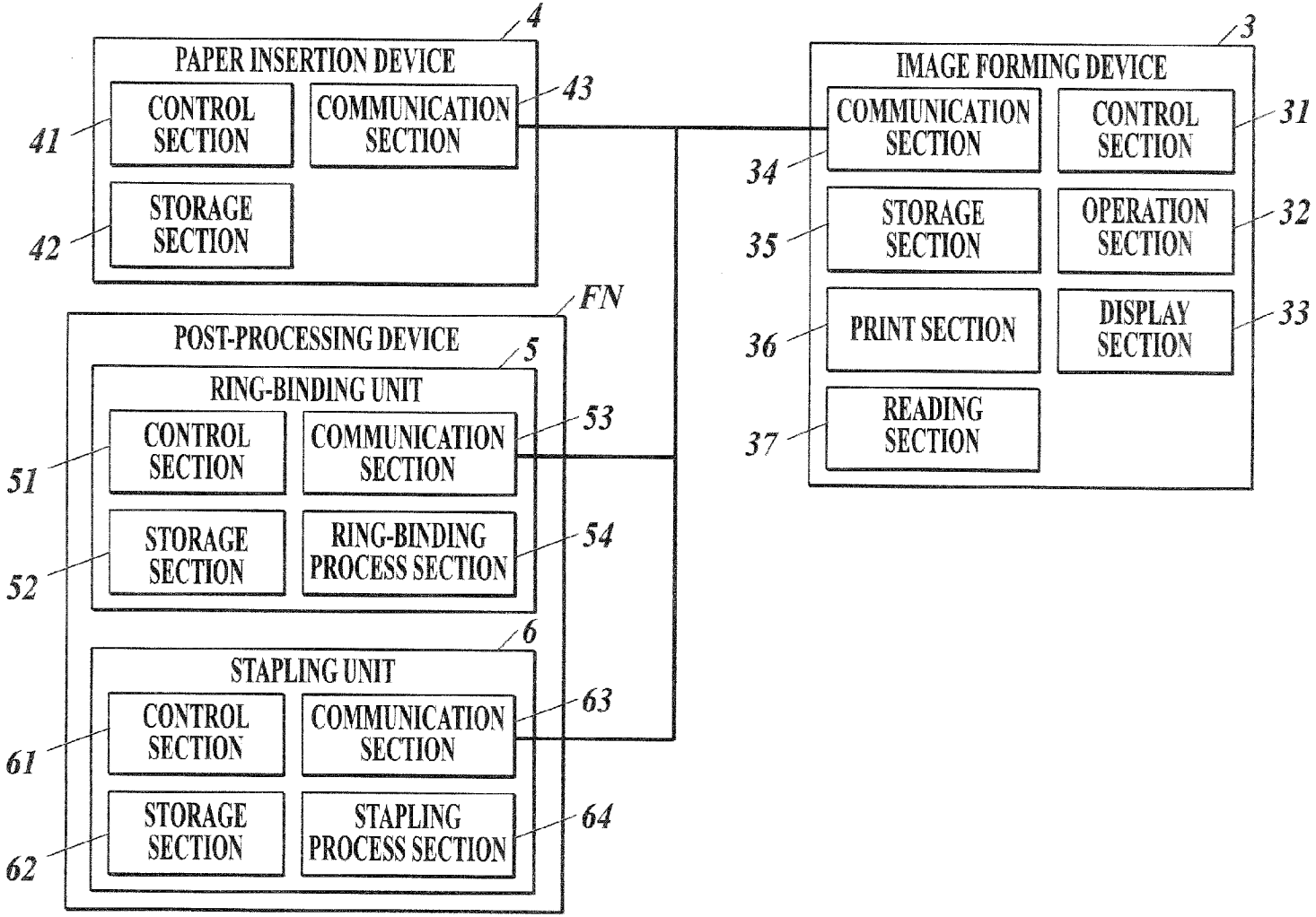
FIG. 8 is a diagram showing a functional configuration of the image forming system of FIG. 1.

FIG. 8 is a functional block diagram of the above described image forming system 1.

As shown in FIG. 8, the image forming device 3 includes a control section 31, an operation section 32, a display section 33, a communication section 34, a storage section 35, a print section 36 and a reading section 37.

The control section 31 is constituted of CPU (Central Processing Unit), ROM (Random Access Memory) and so forth. The control section 31 performs various types of calculations in cooperation with various types of processing programs stored in the storage section 35 and integrally controls each of the parts in the image forming device 3.

The control section 31 controls so as to feed the papers to which printing is performed by the print section 36 to the post-processing device FN as the booklet main body to be bound as a book. Further, the control section 31 controls so as to feed the front cover and back cover of the booklet and papers for binding the front cover and back cover to the post-processing device FN along with the booklet main body in the paper feeding order of back cover, paper for binding back cover, paper for binding front cover, front cover and the booklet main body. The control section 31 determines the paper sources from where the papers are fed based on the setting of ring-binding and feeds the papers respectively from the paper sources in the above mentioned paper feeding order.

The operation section 32 includes a touch panel 321 and operation keys. The operation section 32 generates operation signals according to user's input operation and outputs the generated operation signals to the control section 31.

The display section 33 displays operations screens and processing results on the touch panel 321 according to the control of the control section 31.

The communication section 34 includes an interface for communication and carries out communication with an external device. For example, the communication section 34 sends and receives control information with the paper insertion device 4, the ring-binding unit 5 and the stapling unit 6 of the post-processing device FN. Further, the communication section 34 receives image data to be print from external servers and computers and outputs the image data to the storage section 35.

The storage section 35 stores parameters, setting data and such like required for processing other than various types of processing programs. Further, the storage section 35 stores image data. As for the storage section 35, hard disk, DRAM (Dynamic RAM) or the like can be used.

The print section 36 performs printing by the electrophotographic method and is constituted of a paper feeding section, exposure section, developing section, transfer section, fixing section and so forth, for example. At the time of printing, the exposure section emits a laser beam on the photosensitive drum to form an electrostatic latent image according to PWM signals obtained by the image data being converted into PWM (Pulse Width Modulation). The developing section performs development processing to this electrostatic latent image by using toner, and when a toner image is formed on the photosensitive drum, the transfer section transfers the toner image on to the paper which is fed from the paper feeding section and the fixing section performs fixing processing of the toner image.

The reading section 37 optically scans the document which is conveyed by the automatic document feeder 371 by the scanner 372 and generates image data.

The paper insertion device 4 includes a control section 41, a storage section 42 and a communication section 43.

The control section 41 is configured similarly to the control section 31 of the image forming device 3, and the control section 41 controls each part in the paper insertion device 4. For example, the control section 41 controls the conveyance of papers which are set in the paper feeding tray T6 or T7 according to control information received from the image forming device 3.

Parameters, setting data and so forth required for processing are stored in the storage section 42 in addition to various types of processing programs.

The communication section 43 is configured similarly to the communication section 34 of the image forming device 3, and communicates with the image forming device 3 and the post-processing device FN.

The ring-binding unit 5 includes a control section 51, a storage section 52, a communication section 53 and a ring-binding process section 54.

The control section 51 is configured similarly to the control section 31 of the image forming device 3, and controls each part in the ring-binding unit 5. For example, the control section 51 makes the ring-binding process section 54 execute the ring-binding processing to the papers fed to the ring-binding unit 5 according to control information received from the image forming device 3.

Parameters, setting data and so forth required for processing are stored in the storage section 52 in addition to various types of processing programs.

The communication section 53 is configured similarly to the communication section 34 of the image forming device 3, and communicates with the image forming device 3, the paper insertion device 4 and the stapling unit 6.

The ring-binding process section 54 executes the above described ring-binding processing.

The stapling unit 6 includes a control section 61, a storage section 62, a communication section 63 and a stapling process section 64.

The control section 61 is configured similarly to the control section 31 of the image forming device 3, and the control section 61 controls each part in the stapling unit 6. For example, the control section 61 makes the stapling process section 64 execute the stapling processing to the papers fed to the stapling unit 6 according to control information received from the image forming device 3.

Parameters, setting data and so forth required for processing are stored in the storage section 62 in addition to various types of processing programs.

The communication section 63 is configured similarly to the communication section 34 of the image forming device 3, and communicates with the image forming device 3, the paper insertion device 4 and the ring-biding unit 5.

The stapling process section 64 executed the above described stapling processing.

Next, operation of the image forming system 1 when a job including the ring-binding processing is executed will be described.

Figure 9:
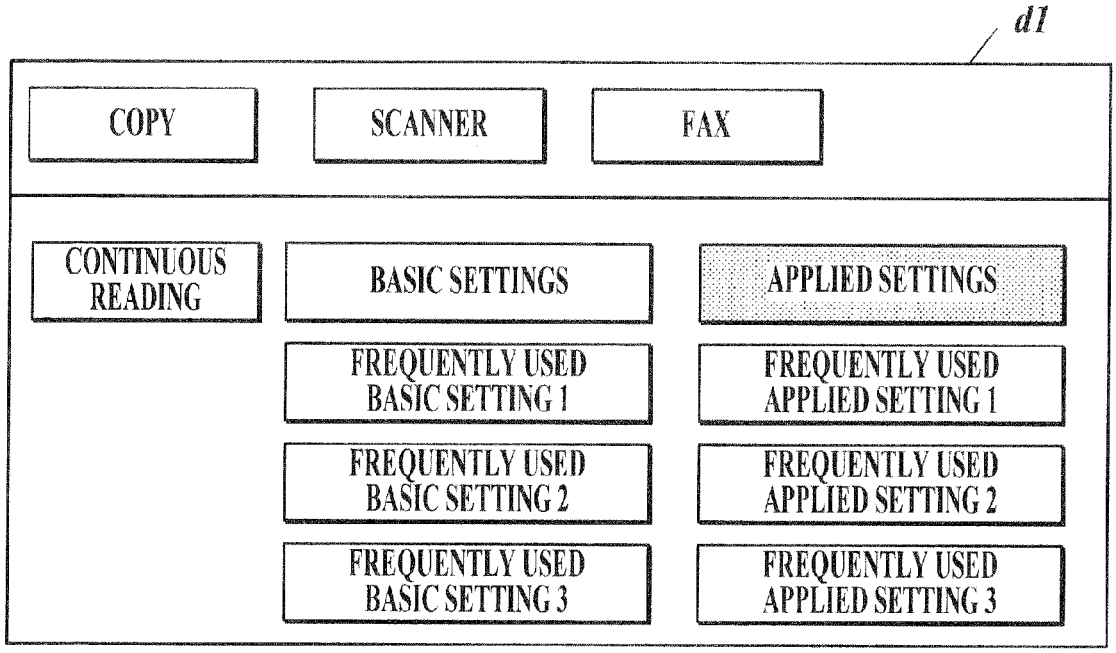
FIG. 9 is a diagram of an operation screen of a main menu.
Figure 10:
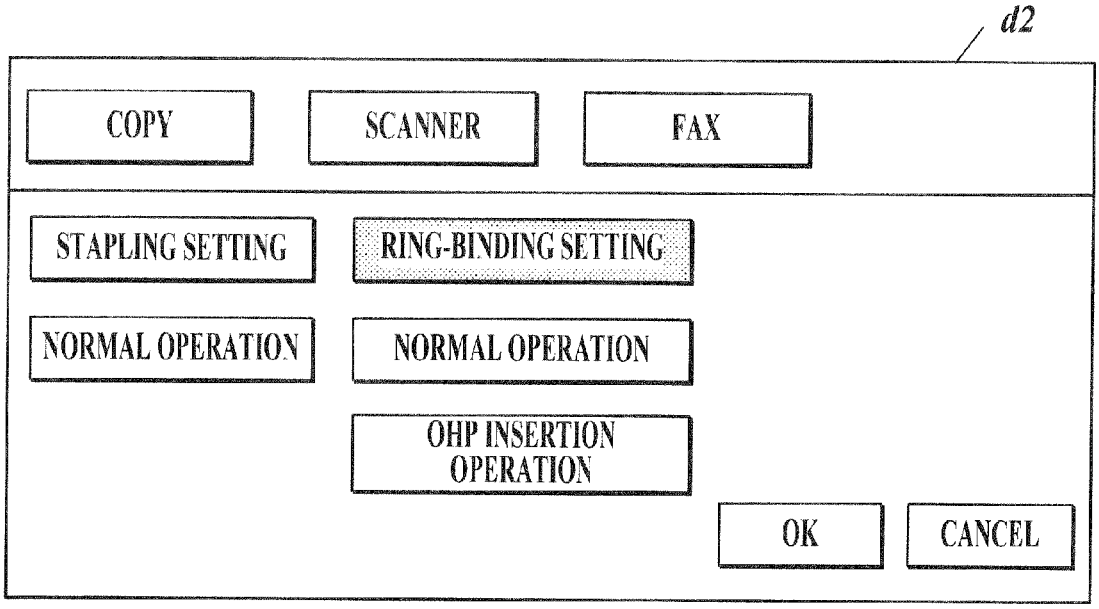
FIG. 10 is a diagram of an operation screen of applied setting.
Figure 11:
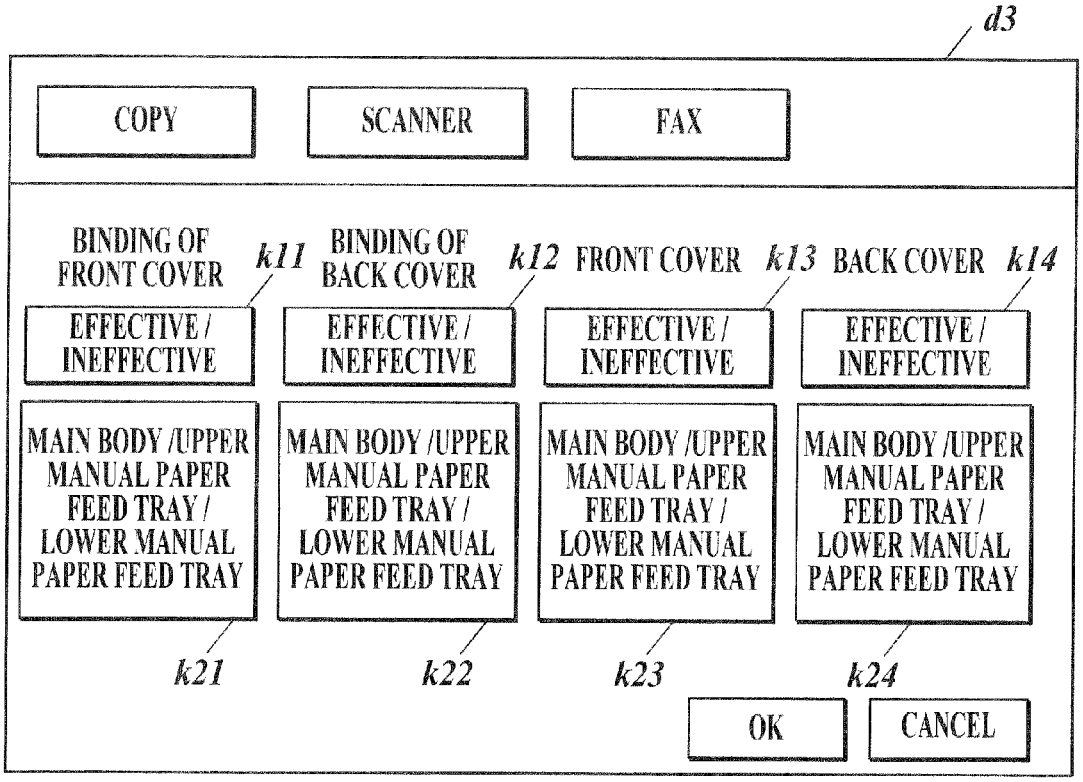
FIG. 11 is a diagram of an operation screen of ring-binding setting.

FIGS. 9 to 11 show operation screens according to job settings including the ring-binding processing.

In a stand-by state, the display section 33 displays an operation screen d1 of main menu shown in FIG. 9. In the operation screed d1, when a user operates to select an article "applied setting" via the operation section 32, the display section 33 displays an operation screen d2 of applied setting shown in FIG. 10. When a setting related to the ring-binding processing is to be performed, a user is to operate to select an article "ring-binding setting".

When a user operates to selects the article "ring-binding setting" in the operation screed d2, the display section 33 displays an operation screen d3 of ring-binding setting shown in FIG. 11.

In the operation screen d3, keys k11 to k14 for respectively selecting whether the booklet is to be book-bound by using font cover, back cover, paper for binding front cover and paper for binding back cover at the time of ring-binding processing. In each of the keys k11 to k14, the display of the key is to switch between effective and ineffective every time the key is operated. A user operates the keys among the keys k11 to k14 corresponding to the papers needed for the book-binding to switch to the display of "effective" and operates the keys among the keys k11 to k14 of the papers not needed for the book-binding to switch to the display of "ineffective".

Below the keys k11 to k14, keys k21 to k24 for respectively selecting the paper sources from where front cover, back cover, paper for binding front cover and paper for binding back cover are fed are displayed. In each of the keys k21 to k24, the display of the key is to switch between "main body", "upper manual paper feed tray" and "lower manual paper feed tray" every time the key is operated. Here, "main body" means that the paper source is the image forming device 3. In particular, "main body" indicates the paper feeding trays T1 to T5 holding papers which are same as the papers of the booklet main body to be printed in the image forming device 3. Further, the paper source displayed as "upper manual paper feed tray" indicates the paper feeding tray T6 of the paper insertion device 4, and the paper source displayed as "lower manual paper feed tray" indicates the paper feeding tray T7 of the paper insertion device 4.

For example, when only front cover is to be used for binding a booklet and the paper for front cover is to be fed from the image forming device 3, a user operates the key k13 of front cover to set the key k13 to "effective" and operates the other keys k11, k12 and k14 to set them to "ineffective". Further, a user operates the key k23 to set the key k23 to "main body". When all of front cover, back cover and papers form binding front cover and back cover are to be used for the book-binding, a user operates the keys k11 to k14 to set all of the keys to "effective" and operates the keys k21 to k24 respectively to set the paper sources from where the front cover, back cover and papers for binding the front cover and back cover are to be fed.

Figure 12:
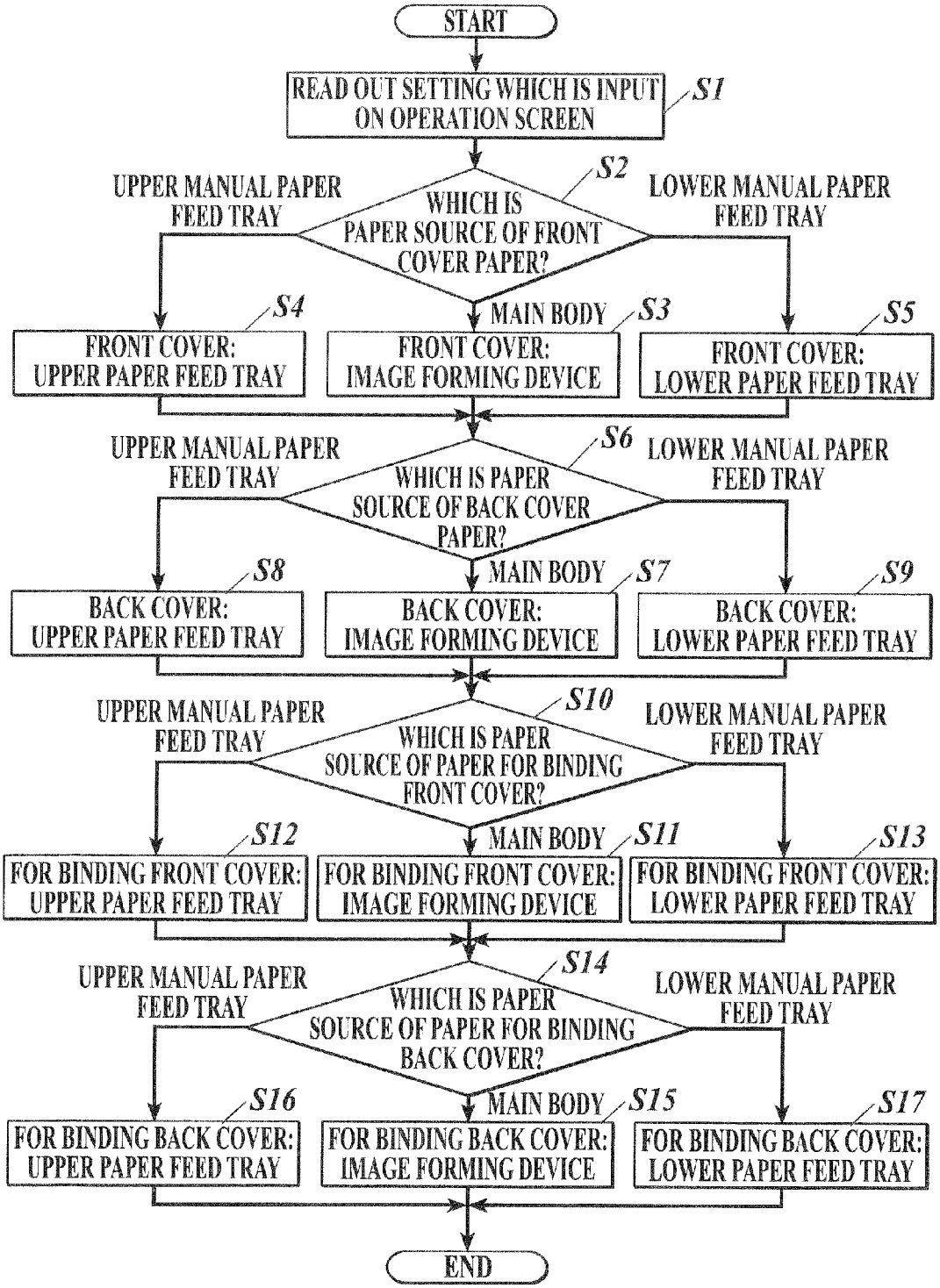
FIG. 12 is a flowchart of a paper source control processing.

When the job in which the ring-binding processing is set is executed as described above, the control section 31 of the image forming device 3 executes paper source control processing. FIG. 12 is a flowchart of the paper source control processing.

As shown in FIG. 12, the control section 31 reads out a setting related to the ring-binding processing which is input by a user in the operation screen d3 (step S1) and determines the selected paper source as the paper source of the paper for front cover (step S2).

When the selected paper source is "main body" (step S2; main body), the control section 31 decides that the paper source of the paper for front cover is the image forming device 3 (step S3). When the selected paper source is "upper manual paper feed tray" (step S2; upper manual paper feed tray), the control section 31 decides that the paper source of the paper for front cover is the paper feeding tray T6 of the paper insertion device 4 (step S4). When the selected paper source is "lower manual paper feed tray" (step S2; lower manual paper feed tray), the control section 31 decides that the paper source of the paper for front cover is the paper feeding tray T7 of the paper insertion device 4 (step S5).

Similarly to the front cover, the control section 31 determines the paper source which is selected as the paper source of the paper for back cover (step S6). When the selected paper source is "main body" (step S6; main body), the control section 31 decides that the paper source of the paper for back cover is the image forming device 3 (step S7). When the selected paper source is "upper manual paper feed tray" (step S6; upper manual paper feed tray), the control section 31 decides that the paper source of the paper for back cover is the paper feeding tray T6 of the paper insertion device 4 (step S8). When the selected paper source is "lower manual paper feed tray" (step S6; lower manual paper feed tray), the control section 31 decides that the paper source of the paper for back cover is the paper feeding tray T7 of the paper insertion device 4 (step S9).

Next, the control section 31 determines the paper source which is selected as the paper source of the paper for binding front cover (step S10). When the selected paper source is "main body" (step S10; main body), the control section 31 decides that the paper source of the paper for binding front cover is the image forming device 3 (step S11). When the selected paper source is "upper manual paper feed tray" (step S10; upper manual paper feed tray), the control section 31 decides that the paper source is the paper feeding tray T6 of the paper insertion device 4 (step S12). When the selected paper source is "lower manual paper feed tray" (step S10; lower manual paper feed tray), the control section 31 decides that the paper source is the paper feeding tray T7 of the paper insertion device 4 (step S13).

Next, the control section 31 determines the paper source which is selected as the paper source of the paper for binding back cover (step S14). When the selected paper source is "main body" (step S14; main body), the control section 31 decides that the paper source of the paper for binding back cover is the image forming device 3 (step S15). When the selected paper source is "upper manual paper feed tray" (step S14; upper manual paper feed tray), the control section 31 decides that the paper source is the paper feeding tray T6 of the paper insertion device 4 (step S16). When the selected paper source is "lower manual paper feed tray" (step S14; lower manual paper feed tray), the control section 31 decides that the paper source is the paper feeding tray T7 of the paper insertion device 4 (step S17).

When the paper sources of the papers are decided as described above, the control section 31 decides the paper feeding order in sequence of 1 to 5 described below. When the booklet main body is constituted of a plurality of pages, the control section 31 decides the paper feeding order be in ascending order such as from page 1, page 2 . . . and so on.

1: back cover
2: paper for binding back cover
3: paper for binding front cover
4: front cover
5: booklet main body Here, when any of the papers of the front cover, the back cover and the papers for binding the front cover and the back cover is set to be ineffective by a user, the control section 31 skips the determination processing of the papers which are set to ineffective in the paper source control processing. Also in the decision of paper feeding order, the control section 31 deletes the papers which are set to ineffective from the paper feeding order and moves up the orders of the papers which come thereafter.

Next, the control section 31 generates job information including the instructions of paper source and paper feeding order. The job information is control information which gives instruction on a series of processing from printing to post-processing, and the job information includes instructions on printing condition, post-processing condition and so forth. In accordance with the instruction of the control section 31, the communication section 34 transmits the generated job information to the paper insertion device 4 and the ring-binding unit 5. The print section 36 starts printing according to the job information and conveys the papers to which printing is performed to the paper insertion device 4 as the booklet main body.

At this time, when there are papers where the image forming device 3 is theirs paper source, the control section 31 determines the paper feeding orders of those papers and the paper feeding order of the booklet main body from the job information and controls the conveyance timings. For example, when the image forming device 3 is the paper sources of front cover and back cover, the control section 31 feeds the back cover and then the front cover from the paper feeding trays T1 to T6 and conveys the back cover and the front cover to the paper insertion device 4 before conveying the booklet main body from the print section 36.

The paper insertion device 4 conveys the papers to be fed to the image forming device 3 to the ring-binding unit 5. At this time, if there is an instruction on paper feeding in the job information transmitted from the image forming device 3, the paper insertion device 4 feeds and conveys papers at specified timings from the paper feeding trays T6 or T7 as instructed in the job information. In the above described example, when the paper feeding tray T6 of the paper insertion device 4 is the paper source of the papers for binding front cover and back cover, the paper insertion device 4 conveys the first paper (back cover) fed from the image forming device 3 to the ring-binding unit 5. Then, the paper insertion device 4 feeds and conveys two papers in a row form the paper feeding tray T6 and conveys the third paper and the papers thereafter (front cover and booklet main body) which are fed from the image forming device 3.

The ring-binding unit 5 carries out the ring-binding processing to the papers which are sequentially fed from the paper insertion device 4 and discharges the finished booklets in accordance to the job information transmitted from the image forming device 3. The papers are fed in the paper feeding order of (1) back cover, (2) paper for binding back cover, (3) paper for binding front cover, (4) front cover and (5) booklet main body, and they are stacked in the stack section 542 in this order to be bound by a ring-binding member. As a result, the booklet shown in FIG. 4 is obtained.

Figure 13:
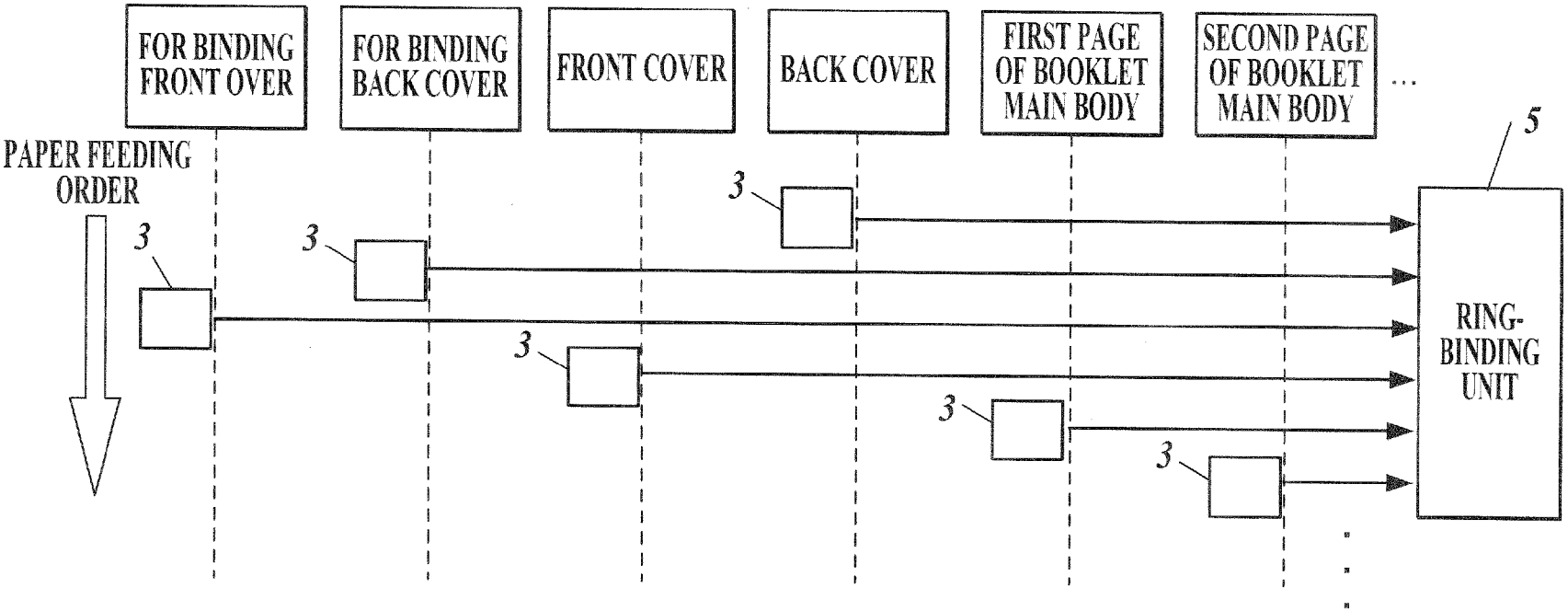
FIG. 13 is a diagram showing an example of a control of paper sources and paper feeding order.
Figure 14:
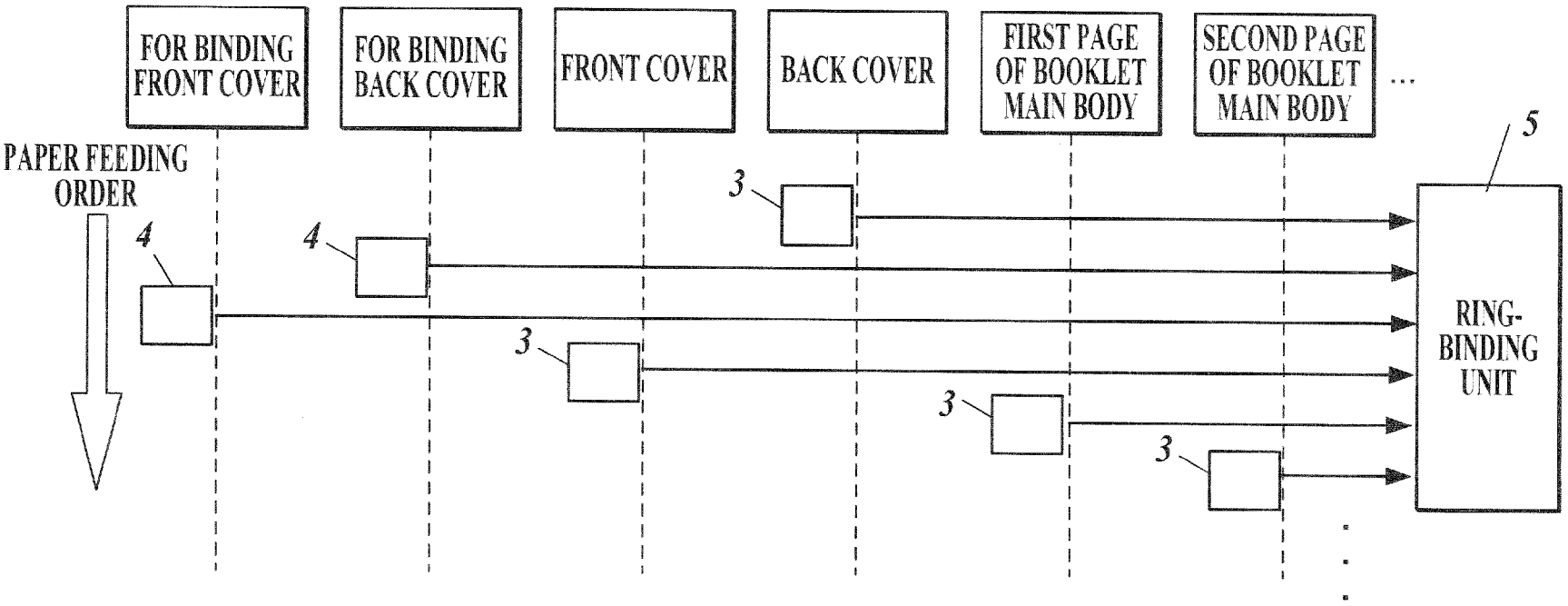
FIG. 14 is a diagram showing an example of a control of paper sources and paper feeding order.
Figure 15:
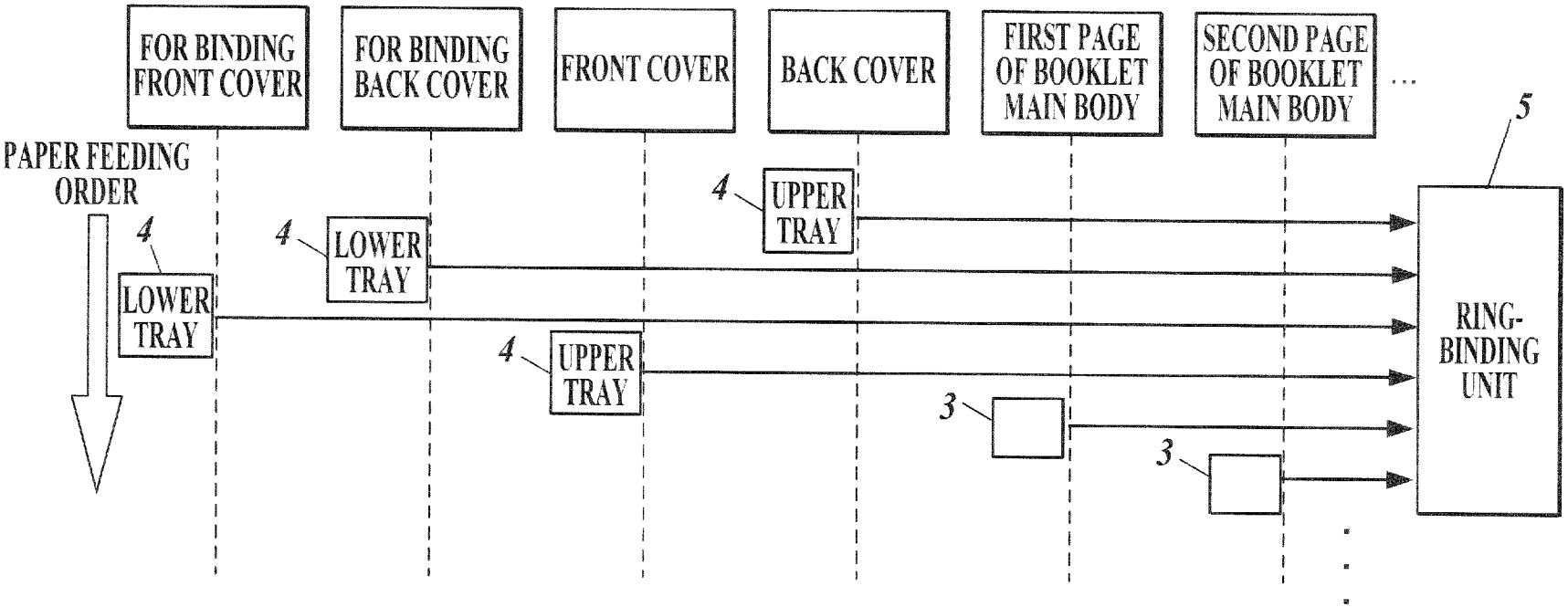
FIG. 15 is a diagram showing an example of a control of paper sources and paper feeding order.

FIGS. 13 to 15 show examples of paper source control and paper feeding order control of the papers to be fed to the ring-binding unit 5.

For example, when using papers such as regular papers, often set in the paper feeding trays T4 and T5 in the image forming device 3, as the cover paper or the like, a user is to select the image forming device 3 as the paper source of all the paper in the operation screen d3. In such case, as shown in FIG. 13, back cover, paper for binding back cover, paper for binding front cover, front cover, first page of booklet and second page of booklet are sequentially fed to the ring-binding unit 5 from the image forming device via the paper insertion device 4.

When special papers such as OHP sheets are used as the papers for binding, a user is to manually set the paper feeding tray T6 or T7 of the paper insertion device 4 and select the paper feeding tray T6 or T7 as the paper source. In such case, as shown in FIG. 14, after the paper for back cover is fed from the image forming device 3, the paper for binding back cover and the paper for binding front cover are fed from the paper feeding tray T6 or T7 of the paper insertion device 4. Thereafter, papers are fed by switching the paper source to the image forming device 3.

When special papers are to be used for front cover and back cover in addition to the papers for binding, a user may separately use the two paper feeding trays T6 and T7 of the paper insertion device 4 accordingly. For example, a user is to set papers for front cover and back cover in the upper paper feeding tray T6 of the paper insertion device 4 and set papers for binding in the lower paper feeding tray T7 of the paper insertion device 4. In such case, after the papers set in the paper feeding tray T6 is conveyed to the ring-binding unit 5 as shown in FIG. 15, two of the papers set in the paper feeding tray T7 are conveyed one after another. When a paper for front cover is conveyed from the paper feeding tray T6 again, the papers to which printing is performed are conveyed to the ring-binding unit 5 from the image forming device 3 as the booklet main body.

As described above, according to this embodiment, the image forming device 3 includes the paper feeding trays T1 to T5, the print section 36 to perform printing to the papers fed from the paper feeding trays T1 to T5, and the control section 31 for controlling to feed the papers to which printing is performed to the post-processing device as the booklet main body to be book-bound. The stapling unit 6 of the post-processing device FN carries out the ring-binding processing to the fed papers and binds the booklet into a book. The control section 31 controls so as to feed the front cover, back cover and papers for binding of the booklet to the stapling unit 6 along with the booklet main body, and the order for feeding is in the order of back cover paper, papers for binding, front cover paper and papers of the booklet main body.

In such way, the papers are mounted in the order of back cover paper, papers for binding, front cover paper and booklet main body in the ring-binding process section 54 and the papers can be bound by the ring-binding member B. By flipping over the bound booklet at the position of papers for binding (the flipping position z4 shown in FIG. 4), a booklet in which the booklet constituted of the front cover, booklet main body and back cover is further bound with the paper for binding can be obtained.

Moreover, the paper insertion device 4 includes the paper feeding trays T6 and T7 which can feed papers for binding, and the control section 31 of the image forming device 3 controls the paper feeding from the paper feeding trays T6 and T7 of the paper insertion device 4. When the ring-binding processing is to be executed, the control section 31 may feed the papers for binding from the paper feeding trays T6 and T7 of the paper insertion device 4 in the above mentioned paper feeding order and may feed papers for the back cover, front cover and booklet main body from the image forming device 3. When using papers which are not contained in the image forming device 3 as papers for binding, the papers for binding can be fed from the paper insertion device 4.

Further, when the ring-binding processing is to be executed, the control section 31 of the image forming device 3 may control so as to feed the papers for back cover, binding papers and front cover from the paper feeding trays T6 and T7 in the above mentioned paper feeding order and to feed the papers for booklet main body from the image forming device 3. In such way, papers other than the booklet main body can be fed from the paper insertion device 4.

Because the control section 31 of the image forming device 3 controls so as to feed two binding papers one after another in the above mentioned paper feeding order, both the front cover and the back cover can be bound by the binding papers.

Here, the present invention is not limited to the above embodiment in any way.

For example, an example where the papers to which printing is performed by the print section 36 are fed to the post-processing device FN as the booklet main body is shown. However, the booklet main body can be fed from the paper feeding tray T6 or T7 of the paper insertion device 4.

Moreover, the configuration may be such that printing is performed to the front cover and back cover or to the binding papers of front cover and back cover by the print section 36.

Further, the post-processing device FN which can perform ring-binding processing and stapling processing is shown in the above embodiment. However, the post-processing device can be a device which can perform other post-processing such as folding processing and hole-punching processing.

Moreover, as for a computer readable medium for a program used for the control, non-volatile memories such as a ROM and a flashcard and portable storing medium such as a CD=ROM can be used.

Further, a carrier wave can be used in the present invention as a medium for providing program data used for the control through a communication circuit.

According to a first aspect of the present invention, an image forming system includes an image forming device including a paper feeding tray, a print section which performs printing to papers fed from the paper feeding tray and a control section which controls so as to feed the printed papers to a post-processing device as a booklet main body to be book-bound, and the post-processing device which carries out ring-binding processing to the fed papers and book-binds a booklet, and the control section controls so as to feed a front cover paper, a back cover paper, papers for binding of the booklet to a ring-binding process section of the post-processing device along with the booklet main body, and a paper feeding order is in an order of the back cover paper, the papers for binding, the front cover paper and the booklet main body.

According to the present invention, the papers are mounted in the order of back cover, papers for binding, front cover and booklet main body at the time of ring-binding processing and the papers can be bound by the ring-binding member. By flipping over the bound booklet at the position of papers for binding (the flipping position z4 shown in FIG. 4), a booklet in which the booklet bound in the order of the front cover, booklet main body and back cover is further bound with the paper for binding can be obtained. That is, the front cover and back cover of the booklet to be book-bound can be further bound.

Preferably, the image forming system further includes a paper insertion device having a paper feeding tray which feeds the papers for binding, and the control section controls a paper feeding from the paper feeding tray of the paper insertion device, and when the ring-binding processing is to be executed, the control section controls so as to feed the papers for binding from the paper feeding tray of the paper insertion device and to feed the back cover paper, the front cover paper and papers of the booklet main body from the image forming device in the paper feeding order.

Preferably, the image forming system further includes a paper insertion device having a paper feeding tray which feeds the papers for binding, and when the ring-binding processing is to be executed, the control section controls so as to feed the back cover paper, the papers for binding, the front cover papers from the paper feeding tray of the paper insertion device and to feed papers of the booklet main body from the image forming device in the paper feeding order.

Preferably, the control section controls so as to feed two papers for binding one after another in the paper feeding order.

Moreover, according to a second aspect of the present invention an image forming device includes a paper feeding tray, a print section which performs printing to papers fed from the paper feeding tray and a control section which controls so as to carry out ring-binding processing to the fed papers and to feed the printed papers to a post-processing device which book-binds a booklet as a booklet main body to be book-bound, and the control section controls so as to feed a front cover paper, a back cover paper, papers for binding of the booklet to a ring-binding process section of the post-processing device along with the booklet main body, and a paper feeding order is in an order of the back cover paper, the papers for binding, the front cover paper and the booklet main body.

According to the present invention, the papers are mounted in the order of back cover paper, papers for binding, front cover paper and the booklet main body at the time of ring-binding processing and the papers can be bound by the ring-binding member. By flipping over the bound booklet at the position of papers for binding, a booklet in which the booklet bound in the order of the front cover, booklet main body and back cover is further bound with the papers for binding can be obtained. That is, the front cover and the back cover of the booklet to be book-bound can be further bounded.

Preferably, the control section controls a paper feeding from an external paper feeding tray from which the papers for binding are fed, and when the ring-binding processing is to be executed, the control section controls so as to feed the papers for binding from the external paper feeding tray and to feed the back cover paper, the front cover paper and papers of the booklet main body from the image forming device in the paper feeding order.

Preferably, the control section controls a paper feeding from an external paper feeding tray from which the papers for binding are fed, and when the ring-binding processing is to be executed, the control section controls so as to feed the back cover paper, the papers for binding, the front cover paper from the external paper feeding tray and to feed papers of the booklet main body from the image forming device in the paper feeding order.

Preferably, the control section controls so as to feed two papers for binding one after another in the paper feeding order.

The present U.S. patent application claims a priority under the Paris Convention of Japanese patent application No. 2011-037794 filed on Feb. 24, 2011, which shall be a basis of correction of an incorrect translation.

What is claimed is:

1. An image forming system, comprising:

an image forming device comprising a paper feeding tray, a print section which performs printing to papers fed from the paper feeding tray, and a control section which controls so as to feed the printed papers to a post-processing device as a booklet main body to be book-bound; and the post-processing device which carries out ring-binding processing to the fed papers and book-binds a booklet, wherein the control section controls so as to feed a front cover paper, a back cover paper, papers for binding of the booklet to a ring-binding process section of the post-processing device along with the booklet main body, and a paper feeding order is in an order of the back cover paper, the papers for binding, the front cover paper and the booklet main body.

2. The image forming system of claim 1 further comprising:

a paper insertion device having a paper feeding tray which feeds the papers for binding, wherein the control section controls a paper feeding from the paper feeding tray of the paper insertion device, and when the ring-binding processing is to be executed, the control section controls so as to feed the papers for binding from the paper feeding tray of the paper insertion device and to feed the back cover paper, the front cover paper and papers of the booklet main body from the image forming device in the paper feeding order.

3. The image forming system of claim 1 further comprising:

a paper insertion device having a paper feeding tray which feeds the papers for binding, wherein when the ring-binding processing is to be executed, the control section controls so as to feed the back cover paper, the papers for binding, the front cover papers from the paper feeding tray of the paper insertion device and to feed papers of the booklet main body from the image forming device in the paper feeding order.

4. The image forming system of claim 1, wherein the control section controls so as to feed two papers for binding one after another in the paper feeding order.

5. An image forming device, comprising:

a paper feeding tray;

a print section which performs printing to papers fed from the paper feeding tray; and a control section which controls so as to carry out ring-binding processing to the fed papers and to feed the printed papers to a post-processing device which book-binds a booklet as a booklet main body to be book-bound, wherein the control section controls so as to feed a front cover paper, a back cover paper, papers for binding of the booklet to a ring-binding process section of the post-processing device along with the booklet main body, and a paper feeding order is in an order of the back cover paper, the papers for binding, the front cover paper and the booklet main body.

6. The image forming device of claim 5, wherein the control section controls a paper feeding from an external paper feeding tray from which the papers for binding are fed, and when the ring-binding processing is to be executed, the control section controls so as to feed the papers for binding from the external paper feeding tray and to feed the back cover paper, the front cover paper and papers of the booklet main body from the image forming device in the paper feeding order.

7. The image forming device of claim 5, wherein the control section controls a paper feeding from an external paper feeding tray from which the papers for binding are fed, and when the ring-binding processing is to be executed, the control section controls so as to feed the back cover paper, the papers for binding, the front cover paper from the external paper feeding tray and to feed papers of the booklet main body from the image forming device in the paper feeding order.

8. The image forming device of claim 5, wherein the control section controls so as to feed two papers for binding one after another in the paper feeding order.

* * * * *